US006161763A

United States Patent [19]

Reuter

[11] Patent Number: 6,161,763

[45] Date of Patent: Dec. 19, 2000

[54] MODULE-CONTROLLED BUILDING DRYING SYSTEM AND PROCESS

[76] Inventor: Grant Reuter, 313 North Oak, Burlington, Wash. 98233

[21] Appl. No.: 09/264,583

[22] Filed: Mar. 9, 1999

Related U.S. Application Data

[60] Provisional application No. 60/077,326, Mar. 9, 1998.

[51] Int. Cl.[7] ..... B01F 3/02; F25B 29/00

[52] U.S. Cl. ..... 236/44 C; 165/224; 454/258

[58] Field of Search ..... 236/44 C, 44 A, 236/49.3; 165/224; 454/258, 229; 34/486, 491

[56] References Cited

U.S. PATENT DOCUMENTS

| | | | |
|---|---|---|---|
| 3,332,620 | 7/1967 | Streed | 236/44 A |
| 4,964,566 | 10/1990 | Pugh et al. | 236/49.3 |
| 5,881,951 | 3/1999 | Carpenter | 236/44 A |

*Primary Examiner*—William Wayner
*Attorney, Agent, or Firm*—Davis Wright Tremaine LLP

[57] ABSTRACT

There is disclosed a module control system and wet (i.e., flooded) building drying process that controls drying air circulation between inside and outside the building based upon absolute humidity and temperature sensor measurements.

11 Claims, 1 Drawing Sheet

MODULE-CONTROLLED BUILDING DRYING SYSTEM AND PROCESS

CROSS-REFERENCE TO RELATED APPLICATIONS

This application claims priority under 35 USC §119 from U.S. Provisional Application Ser. No. 60/077,326, filed Mar. 9, 1998.

FIELD OF THE INVENTION

The present invention provides a modular control system and wet (i.e., flooded) building drying process that controls drying air circulation between inside and outside the building based upon absolute humidity and temperature sensor measurements.

BACKGROUND

There has been increasing disruption of global weather patterns that has caused supposedly rare flooding to occur on more frequent intervals. Flooding, wherever it occurs, leaves behind local communities of water-damaged buildings (houses and larger structures) that has given rise to a growing Water Damage Restoration Industry (WDRI). Building flooding can also occur when internal water systems fail or a fire is extinguished, leaving a water-damaged building for restoration.

Water-damage restoration consists essentially of drying out the buildings and its contents. Drying a building and its contents is usually done with a combination of fans and dehumidifiers. This is called a "closed drying system" wherein the doors and windows of the building are closed and the drying work is done with recirculated air. There are times when outside air is drier and can be used instead of overtaxing a dehumidifier system. This is called an "open drying system." However, the outside weather can change and slow down the building restoration process if the mix of proper air is not accomplished. Therefore, there is a need in the art for a control system that can continuously control the mixtures of inside air for closed drying systems and outside air for open drying systems, depending upon the proper air conditions. The present invention was made to address this need in the art.

SUMMARY OF THE INVENTION

The present invention provides a programmed module for controlling fans, ducting, dehumidifying and air sourcing for restoring a target site within a water-damaged building comprising:

(a) a programmed controller element having input and output ports, wherein the input ports are connected to one or a plurality of outside absolute humidity sensors, one or a plurality of inside absolute humidity sensors, and one or a plurality of inside temperature sensors, wherein the output ports are connected to one or a plurality of fan systems, wherein the controller element is programmed to compare if the outside air has a lower absolute humidity than the inside air whereupon the fan system output will be activated, or if the outside air has a higher absolute humidity than the inside air whereupon the fan system will be shut down, or if the target site temperature is below a preset input whereupon the fan system will be shut down;

(b) an outside absolute humidity sensor measuring the absolute humidity of outside air adjacent to the building, and an inside absolute humidity sensor measuring the absolute humidity of air in a target site, wherein each absolute humidity sensor provides a signal to the input of the controller; and (c) a thermometer located in the target site providing a signal to the programmed controller element corresponding to the temperature of air in the target site.

Preferably, the programmed controller element further comprises indicator systems to provide a visual display of the condition of the system being controlled by the programmed controller element. Most preferably, the indicator systems are lights indicating the status of the fan system.

The present invention further provides a process for controlling the introduction of drier air into a target site of a water-damaged building, comprising:

(a) determining the absolute humidity of indoor air at or near the target site and the absolute humidity of air outside of the building;

(b) determining the temperature of the air at the target site; and (c) controlling the source of air to be blown in the target site such that the driest air source is used. Preferably, the controlling step is done with a programmed controller element described herein.

DETAILED DESCRIPTION OF THE INVENTION

Figure 1:
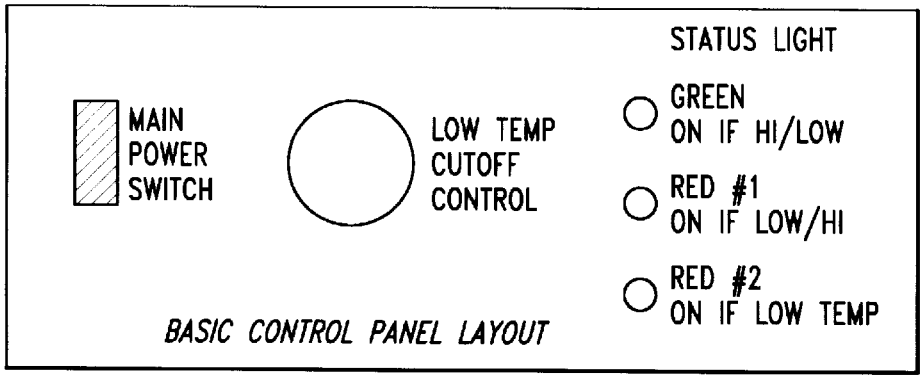
FIG. 1 shows an illustration of a control panel read-out according to an embodiment of the present inventive apparatus. In this configuration, the green light on indicates that outside air has a lower grain loading than inside air. When the green light is on, fan circuits are activated and the fan(s) are drawing air to the target site (area of water damage). The target site temperature is above a low temperature cutoff. When the red light #1 is on, the outside air has a higher grain loading than the inside air and the fan circuits are shut down. When red light #2 is on, the target site temperature has dropped below a preset temperature and the fan circuits have shut down regardless of humidity because there will be too much heat loss in the building.
Figure 2:
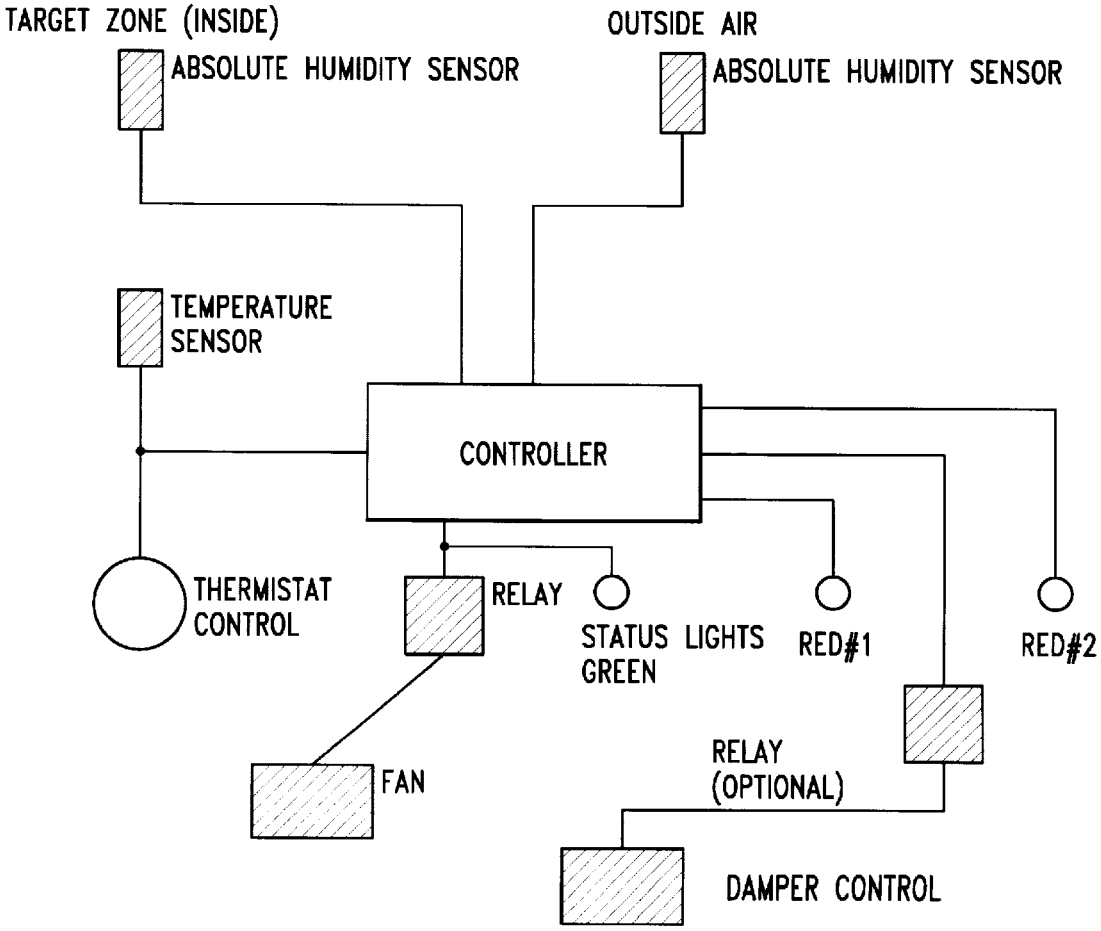
FIG. 2 illustrates a basic circuit layout of a controller system according to FIG. 1. The controller has binary inputs for inside (target site) absolute humidity, outside air absolute humidity, and temperature (target site), status indicators (lights), and outputs to relay controls for fans and dampers (to control inflow of outside air).

The present invention provides a programmed module for controlling fans, ducting, dehumidifying and air sourcing for restoring a target site within a water-damaged building comprising:

(a) a programmed controller element having input and output ports, wherein the input ports are connected to one or a plurality of outside absolute humidity sensors, one or a plurality of inside absolute humidity sensors, and one or a plurality of inside temperature sensors, wherein the output ports are connected to one or a plurality of fan systems, wherein the controller element is programmed to compare if the outside air has a lower absolute humidity than the inside air whereupon the fan system output will be activated, or if the outside air has a higher absolute humidity than the inside air whereupon the fan system will be shut down, or if the target site temperature is below a preset input whereupon the fan system will be shut down;

(b) an outside absolute humidity sensor measuring the absolute humidity of outside air adjacent to the building, and an inside absolute humidity sensor measuring the absolute humidity of air in a target site, wherein each absolute humidity sensor provides a signal to the input of the controller; and (c) a thermometer located in the target site providing a signal to the programmed controller element corresponding to the temperature of air in the target site.

Preferably, the programmed controller further comprises indicator systems to provide a visual display of the condition of the system being controlled by the programmed controller element. Most preferably, the indicator systems are lights indicating the status of the fan system, i.e. whether the fan system is on or off, and whether they are running in normal or reverse mode.

The present invention provides an advance in the water damage restoration industry to better take advantage of open drying systems to allow nature to do more of the work to dry out water-damaged buildings. The inventive programmed controller system, connected to standard axial fans set up to exchange indoor and outdoor air on restoration jobs, results in dramatically increased early-stage drying rates that will reduce early stage damage (e.g., mildew). The inventive programmed controller system allows for a better understanding of psychometry and the ability to continuously analyze indoor and outdoor conditions to switch from open to closed (or vice versa) automatically.

The programmed controller element provides for three input sensors. The indoor and outdoor absolute humidity indicators provide for the driest air to be circulated in the target site. One or more of the absolute humidity sensors may be absolute humidity sensors which directly measure the absolute humidity, or may be a combination of a relative humidity sensor and a temperature sensor. Where the combination of a relative humidity sensor and a temperature sensor is used, the absolute humidity is calculated from the measurements of these two sensors. In addition, an indoor thermometer acts as an indoor temperature cutoff to avoid excessive indoor temperature loss, depending upon the application.

The present invention further provides a process for controlling the introduction of drier air into a target site of a water-damaged building, comprising:

(a) determining the absolute humidity of indoor air at or near the target site and the absolute humidity of air outside of the building;

(b) determining the temperature of the air at the target site; and (c) controlling the source of air to be blown in the target site such that the driest air source is used. Preferably, the controlling step is done with a programmed controller element described herein.

The determination of absolute humidity of the indoor and outdoor air can be done either by direct measurement using an absolute humidity sensor, or by calculation based on the measurements of co-located relative humidity and temperature sensors.

EXAMPLE 1

This example illustrates a startup application with the sensor readings provided. The following Table 1 provides a start-up situation for water-damaged building restoration.

TABLE 1

| | % relative humidity | dry bulb ° F./C. | absolute humidity g/M$^3$ |
|---|---|---|---|
| Indoor starting conditions | 70 | 95/35 | 17.5 |
| Outdoor starting conditions | 60 | 80/26.6 | 15.2 |

At start-up, the input voltage from the outdoor absolute humidity sensor is lower than the corresponding indoor sensor. If the input voltage from the outdoor sensor is lower (meaning that the absolute humidity outside is lower than inside, according to Table 1, the programmable controller will have the fan systems on to bring the dryer outside area to the target site. The fan system will run until the two input voltages from the indoor and outdoor absolute humidity sensors are equal. At this point, the fan system will shut down, an optional damper control system will go on as will red light #1 (FIG. 1), or until the low temperature preset limit is met. Optionally, a time delay (i.e., 30 min) is programmed into the programmable controller to prevent rapid fan on/off cycles.

EXAMPLE 2

This example illustrates a different startup application from the data in example 1, with the sensor readings provided. The following Table 2 provides a start-up situation for water-damaged building restoration.

TABLE 2

| | % relative humidity | dry bulb ° F./C. | absolute humidity g/M$^3$ |
|---|---|---|---|
| Indoor starting conditions | 70 | 70/21.1 | 12.9 |
| Outdoor starting conditions | 60 | 80/26.6 | 15.2 |

At start-up, the input voltage from the outdoor absolute humidity sensor is higher than the indoor sensor. When these inputs are sent to the programmable controller, the fan system will not be turned on.

In the above two examples air is either blown into the target site or not circulated at all, but there are cases where it is advantageous to use the fan system to extract air from the target site. For example, it may be better to extract air from the target site instead of blowing air in if there are contamination-sensitive areas adjacent or near the target site. Air blowing into the target site creates a positive pressure differential between the target site and adjacent areas and could also introduce contaminants from outside or could stir up contaminants already in the target site. The positive pressure differential drives airflow into the adjacent areas and could spread the contaminants or do other damage in these areas. In such situations, it is preferable to reverse the fan system to create a negative pressure differential so that air is extracted from the target site. The negative pressure differential drives airflow from adjacent areas into the target site and thus discourages migration of contaminants from the target site into adjacent areas.

As shown by the following two examples, the system works in exactly the same way whether the fan system us running in forward or reverse mode.

EXAMPLE 3

This example illustrates a startup application with the sensor readings provided. The following Table 3 provides a start-up situation for water-damaged building restoration where there are, for example, contamination-sensitive areas adjacent to the target site and the fan system must be reversed to create a negative pressure differential.

TABLE 3

| | % relative humidity | dry bulb °F./C. | absolute humidity g/M$^3$ |
|---|---|---|---|
| Indoor starting conditions | 70 | 95/35 | 17.5 |
| Outdoor starting conditions | 60 | 80/26.6 | 15.2 |

At start-up, the input voltage from the outdoor absolute humidity sensor is lower than the corresponding indoor sensor. If the input voltage from the outdoor sensor is lower (meaning that the absolute humidity outside is lower than inside, according to Table 1), the programmable controller will turn the fan systems on in reverse. When running in reverse, the fan system extracts the more humid air from the target site and carries it to the drier outdoor area. The fan system will run until the two input voltages from the indoor and outdoor absolute humidity sensors are equal. At this point, the fan system will shut down, an optional damper control system will go on as will red light #1 (FIG. 1), or until the low temperature preset limit is met. Optionally, a time delay (i.e., 30 min) is programmed into the programmable controller to prevent rapid fan on/off cycles.

EXAMPLE 4

This example illustrates a different startup application from the data in example 1, with the sensor readings provided. The following Table 4 provides a start-up situation for water-damaged building restoration where there are, for example, contamination-sensitive areas adjacent to the target site and the fan system must be reversed to create a negative pressure differential.

TABLE 4

| | % relative humidity | dry bulb °F./C. | absolute humidity g/M$^3$ |
|---|---|---|---|
| Indoor starting conditions | 70 | 70/21.1 | 12.9 |
| Outdoor starting conditions | 60 | 80/26.6 | 15.2 |

At start-up, the input voltage from the outdoor absolute humidity sensor is higher than the indoor sensor. When these inputs are sent to the programmable controller, the fan system will not be turned on.

An embodiment of the present apparatus and method has been described. A person skilled in the art, however, will recognize that many other embodiments are possible, including variations of the embodiments presented. For this reason, the scope of the invention is not to be determined from the description of the embodiment, but must instead be determined solely from the claims that follow.

What is claimed is:

1. A programmed module for controlling fans, ducting, dehumidifying and air sourcing for restoring a target site within a water-damaged building comprising:

(a) a programmed controller element having input and output ports, wherein the input ports are connected to one or a plurality of outside absolute humidity sensors, one or a plurality of inside absolute humidity sensors, and one or a plurality of inside temperature sensors, wherein the output ports are connected to one or a plurality of fan systems, wherein the controller clement is programmed to compare if the outside air has a lower absolute humidity than the inside air whereupon the fan system output will be activated, or if the outside air has a higher absolute humidity than the inside air whereupon the fan system will be shut down, or if the target site temperature is below a preset input whereupon the fan system will be shut down;

(b) an outside absolute humidity sensor measuring the absolute humidity of outside air adjacent to the building, and an inside absolute humidity sensor measuring the absolute humidity of air in a target site, wherein each absolute humidity sensor provides a signal to the input of the controller; and (c) a thermometer located in the target site providing a signal to the programmed controller element corresponding to the temperature of air in the target site.

2. The programmed module of claim 1 wherein the programmed controller element further comprises indicator systems to provide a visual display of the condition of the system being controlled by the programmed controller.

3. The programmed module of claim 2 wherein the indicator systems arc lights indicating the status of the fan system.

4. The programmed module of claim 1 wherein the absolute humidity sensors arc sensors which directly measure absolute humidity.

5. The programmed module of claim 1 wherein the absolute humidity sensors comprise a relative humidity sensor and a temperature sensor, such that the absolute humidity is calculated from relative humidity and temperature measurements.

6. The programmed module of claim 1 wherein the fan system is reversible such that air can be extracted from the target site.

7. A process for controlling the introduction of drier air into a target site of a water-damaged building, comprising:

(a) determining the absolute humidity of indoor air at the target site and the absolute humidity of air outside of the building;

(b) determining the temperature of the air at the target site; and (c) controlling the source of air to be blown into the target site such that, if the outside air has a lower absolute humidity than the inside air, air is blown into the target site, while if the outside air has a higher absolute humidity than the inside air, or if the target site temperature is below a preset input, no air is blown into the target site.

8. The process of claim 7 wherein the controlling step is done with a programmed module, wherein the programmed module comprises:

(a) a programmed controller clement having input and output ports, wherein the input ports arc connected to one or a plurality of outside absolute humidity sensors, one or a plurality of inside absolute humidity sensors, and one or a plurality of inside temperature sensors, wherein the output ports are connected to one or a plurality of fan systems, wherein the controller element is programmed to compare if the outside air has a lower absolute humidity than the inside air whereupon the fan system output will be activated, or if the outside air has a higher absolute humidity than the inside air whereupon the fan system will be shut down, or if the target site temperature is below a preset input whereupon the fan system will be shut down;

(b) an outside absolute humidity sensor measuring the absolute humidity of outside air adjacent to the building, and an inside absolute humidity sensor measuring the absolute humidity of air in a target site, wherein each absolute humidity sensor provides a signal to the input of the controller; and (c) a thermometer located in the target site providing a signal to the programmed controller element corresponding to the temperature of air in the target site.

9. The process of claim 7 wherein determining the absolute humidity comprises directly measuring the absolute humidity.

10. The process of claim 7 wherein determining the absolute humidity comprises calculating the absolute humidity from measurements of relative humidity and temperature.

11. The process of claim 7 further wherein controlling the source of air to be blown in the target site comprises reversing the source of air such that air is extracted from the target site.

* * * * *